US005347087A

United States Patent [19]

Kozuki

[11] Patent Number: 5,347,087

[45] Date of Patent: Sep. 13, 1994

[54] TONE GENERATION DEVICE CAPABLE OF VARYING DELAY TIME LENGTH AT THE START OF TONE GENERATION

[75] Inventor: Koichi Kozuki, Hamamatsu, Japan

[73] Assignee: Yamaha Corporation, Japan

[21] Appl. No.: 985,813

[22] Filed: Dec. 3, 1992

[30] Foreign Application Priority Data

Dec. 6, 1991 [JP] Japan ..... 3-323007

[51] Int. Cl.[5] ..... G10H 1/053; G10H 1/06; G10H 7/04

[52] U.S. Cl. ..... 84/605; 84/622; 84/626

[58] Field of Search ..... 84/604–607, 84/622–633

[56] References Cited

U.S. PATENT DOCUMENTS 4,562,763 1/1986 Kaneko ..... 84/605

FOREIGN PATENT DOCUMENTS 3-1677 1/1991 Japan .

*Primary Examiner*—Stanley J. Witkowski

*Attorney, Agent, or Firm*—Graham & James

[57] ABSTRACT

In a waveform memory, data representing a silent state, e.g., zero value data, is stored in a predetermined first address area and waveform data is stored in a second address area. In response to designation of tone generation, the data representing a silent state is read from a desired number of address locations and, thereafter, tone waveform data is read from a second address area. By this control, time during which the data representing a silent state is read out, i.e., delay time, is determined by the number of address locations and, therefore, absolute time of the delay time is not constant but corresponds to an amount progress of the address signal, i.e., its phase amount. Accordingly, phase relation in a key-on delay can be made independent from tone pitch. For realizing an ensemble effect, the above control is performed in at least two channels in such a manner that, in a first channel, tone waveform data is immediately read out in response to the designation of start of tone generation whereas, in a second channel, the number of address locations for reading out the data representing a silent state is set to a number other than zero thereby is delayed from the designation of start of tone generation.

14 Claims, 7 Drawing Sheets

| TIMBER NUMBER | TONE COLOR DATA GROUP |
|---|---|
| t = 1 | Timber 1<br>OFFSET ADDRESS OA<br>ENVELOPE DATA ENV<br>⋮ |
| t = 2 | Timber 2<br>OFFSET ADDRESS OA<br>ENVELOPE DATA ENV<br>⋮ |
| ⋮ | ⋮ |
| t = 20 | Timber 20<br>OFFSET ADDRESS OA<br>ENVELOPE DATA ENV<br>⋮ |

F I G. 6

| TONE COLOR NUMBER | | |
|---|---|---|
| TN = 1 | Timber A | t = 1 |
| | DELAY ADDRESS LENGTH | DA= 0 |
| | Timber B | t = 1 |
| | DELAY ADDRESS LENGTH | DA=−10 |
| TN = 2 | Timber A | t = 2 |
| | DELAY ADDRESS LENGTH | DA= 0 |
| | Timber B | t = 2 |
| | DELAY ADDRESS LENGTH | DA=−15 |
| ⋮ | ⋮ | ⋮ |
| TN = 10 | Timber A | t = 3 |
| | DELAY ADDRESS LENGTH | DA= 0 |
| | Timber B | t = 7 |
| | DELAY ADDRESS LENGTH | DA= 0 |

F I G. 7

| TIMBER NUMBER | TONE COLOR DATA GROUP |
|---|---|
| t = 1 | Timber 1<br>OFFSET ADDRESS OA<br>DELAY ADDRESS LENGTH DA FOR 1/6 PHASE<br>〃 DA FOR 1/5 PHASE<br>〃 DA FOR 1/4 PHASE<br>〃 DA FOR 1/3 PHASE<br>⋮<br>ENVELOPE DATA ENV |
| t = 2 | Timber 2<br>OFFSET ADDRESS OA<br>DELAY ADDRESS LENGTH DA FOR 1/6 PHASE<br>〃 DA FOR 1/5 PHASE<br>〃 DA FOR 1/4 PHASE<br>〃 DA FOR 1/3 PHASE<br>⋮<br>ENVELOPE DATA ENV |
| ⋮ | ⋮ |
| t = 20 | Timber 20<br>OFFSET ADDRESS OA<br>DELAY ADDRESS LENGTH DA FOR 1/6 PHASE<br>〃 DA FOR 1/5 PHASE<br>〃 DA FOR 1/4 PHASE<br>〃 DA FOR 1/3 PHASE<br>⋮<br>ENVELOPE DATA ENV |

FIG. 11

| | | |
|---|---|---|
| TN = 1 | Timber A | t = 1 |
| | DELAY PRE./ABS.FLAG | D = 0 |
| | Timber B | t = 1 |
| | DELAY PRE./ABS.FLAG | D = 1 |
| TN = 2 | Timber A | t = 2 |
| | DELAY PRE./ABS.FLAG | D = 0 |
| | Timber B | t = 2 |
| | DELAY PRE./ABS.FLAG | D = 1 |
| ⋮ | ⋮ | ⋮ |
| TN =10 | Timber A | t = 3 |
| | DELAY PRE./ABS.FLAG | D = 0 |
| | Timber B | t = 7 |
| | DELAY PRE./ABS.FLAG | D = 0 |

FIG. 12

TONE GENERATION DEVICE CAPABLE OF VARYING DELAY TIME LENGTH AT THE START OF TONE GENERATION

BACKGROUND OF THE INVENTION

This invention relates to a tone generation device having a tone generation delay function (hereinafter referred to as "key-on delay") and, further, to an electronic musical instrument capable of obtaining, by utilizing the key-on delay, an ensemble effect according to which tones of an ensemble performance can be produced.

In a prior art tone generation device, the key-on delay has been used as a method for obtaining an ensemble effect. According to the key-on delay processing, tones of the same tone pitch and tone color are generated individually in two tone generation lines with one tone being generated with a delay from generation of the other tone and, therefore, phases of tone waveforms of the tones generated in the two lines are caused to vary and the ensemble effect is thereby obtained (e.g., Japanese Laid-open Patent Publication Hei2-181795).

In the prior art tone generation device, however, time length during which it is desired to delay the timing of start of tone generation (i.e., delay time) is counted by a counter and this necessitates provision of counters for all tone generation channels with resulting complexity of the circuit design.

Besides, in such key-on delay processing, if the delay time is constant, the phase relation between the two tone generation lines will vary for each tone pitch and, in some case, phases of the two lines will differ by 180 degrees depending upon the tone pitch. In this case, the tones generated in the two lines will cancel each other depending upon the waveform of the tones. For avoiding this cancellation of the tones, it is necessary to differ the delay time in accordance with the tone pitch but this will require a further complicated circuit design.

SUMMARY OF THE INVENTION

It is, therefore, an object of the invention to provide a tone generation device capable of making the phase relation in the key-on delay constant regardless of the tone pitch with a simple structure which does not require a circuit for counting delay time in the key-on delay.

It is also an object of the invention to provide an electronic musical instrument capable of obtaining an ensemble effect by utilizing such key-on delay.

For achieving the above object of the invention, tone generation device comprises tone designation means for designating that a tone should be generated, waveform memory means for storing data representing a silent state in a first address area and storing tone waveform data in a second address area, address signal generation means for generating an address signal for reading out stored data from the waveform memory means, and control means for controlling the address signal generation means to read out the data representing a silent state from address locations of a desired number in the first address area in response to the designation of tone generation and thereafter read out the tone waveform data from the second address area.

A key-on delay effect can be obtained by first reading out, in accordance with the designation of tone generation, the data representing a silent state from address locations of a desired number in the first address area and, thereafter, reading out the tone waveform data from the second address area. Time length during which the data representing a silent state is read out, i.e., delay time, is determined by the number of address locations and, therefore, absolute time is not constant but corresponds to an amount of progress of the address signal, i.e., an amount of phase. Accordingly, the phase relation in the key-on delay can be made independent from the tone pitch. Besides, since the structure adopted in the invention is simply one in which the data representing a silent state is read out in accordance with the address signal, a counter for counting the delay time is not required.

For realizing an ensemble effect, the address signal generation means may generate address signals in at least two channels in response to the designation of tone generation by said tone designation means, and the control means may designate the number of address locations for reading out the data representing a silent state in correspondence to the respective channels and independently for each of the channels and control said address signal generation means independently for each of the channels in accordance with the designated number of address locations whereby time length during which the data representing a silent state is read out can be varied for each of the channels. For example, the control means may designate the number of address locations for reading out the data representing a silent state to zero with respect to a first channel in said channels thereby to read out the tone waveform data immediately in accordance with the designation of tone generation without reading out the data representing a silent state and designate the number of address locations for reading out the data representing a silent state to a number other than zero with respect to a second channel in said channels to delay start of reading of the tone waveform data. In this case, the phase difference between tone waveforms of the respective channels at a starting point of reading of the tone waveform is constant regardless of change in the tone pitch and, therefore, an ensemble effect with a constant delay phase difference can be obtained.

Preferred embodiments of the invention will be described below with reference to the accompanying drawings.

BRIEF DESCRIPTION OF THE DRAWINGS

In the accompanying drawings,

FIG. 6 is a diagram showing schematically an example of storage format of tone color data corresponding to timber numbers;

FIG. 7 is a diagram showing schematically an example of storage format of stored data corresponding to tone color numbers;

FIG. 11 is a diagram showing storage format for explaining an embodiment in which data is contained in tone color data corresponding to timber numbers; and FIG. 12 is a diagram showing storage format for explaining an embodiment in which a flag indicating presence or absence of delay is stored in data corresponding to tone color numbers.

DESCRIPTION OF PREFERRED EMBODIMENTS

Figure 1:
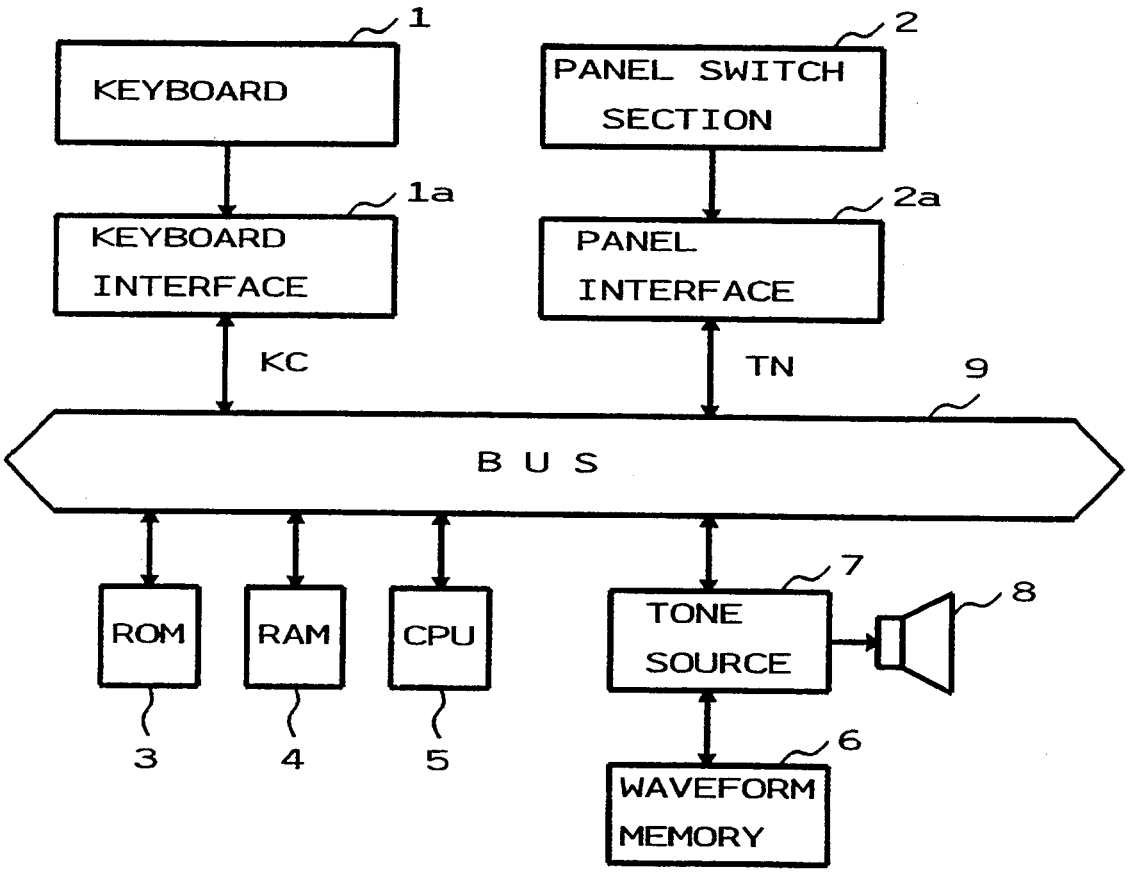
FIG. 1 is a block diagram showing an embodiment of an electronic musical instrument according to the invention.

FIG. 1 is a block diagram showing an embodiment of the electronic musical instrument of the invention. This electronic musical instrument is one of a waveform memory accessing type in which predetermined waveform data is read out for sounding of a tone on the basis of a selected tone color.

A keyboard interface 1*a* detects key events, i.e., depression of a key (key-on) and release of a depressed key (key-off) by scanning a keyboard 1 and produces a key code KC of a key at which a key event has occurred.

Figure 2:
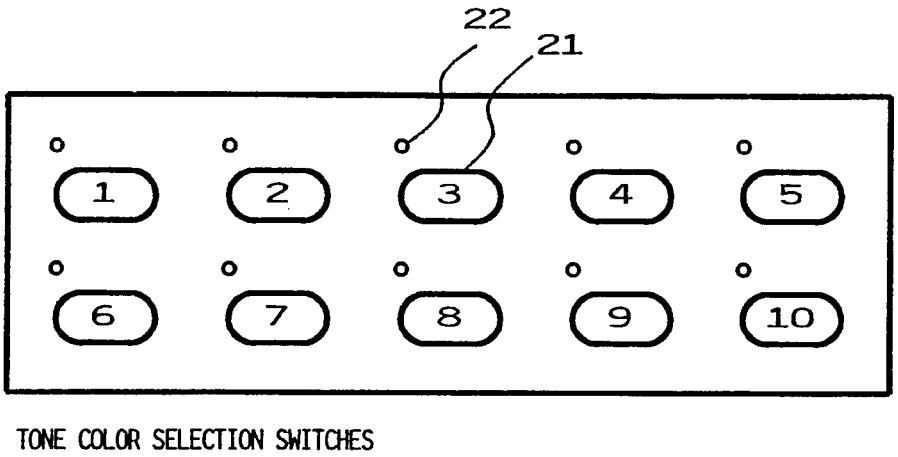
FIG. 2 is a view showing a part of a panel surface of the electronic musical instrument of the embodiment.

A panel switch section 2 includes tone color selection switches 21 for selecting a desired tone color from among plural types of tone colors as shown in FIG. 2 (10 types in this embodiment) and other unillustrated switches. A panel interface 2*a* detects on-off events of these switches of the panel switch section 2.

There are provided light-emitting diodes (LED) 22 beside the tone color selection switches 21 each of which is lighted when a corresponding one of the tone color selection switches 21 has been selected. Tone color numbers TN ranging from "1" to "10" are provided in correspondence to the respective tone color selection switches 21 to distinguish respective tone colors from one another. The panel interface 2*a* detects a tone color number TN of an operated tone color selection switch TN.

A read-only memory (ROM) 3 stores data including tone color data designating a tone color to a tone source circuit 7, address information designating read address of waveform data and a control program. A central processing unit (CPU) 5 receives and sends out various information through a bus 9 and controls an operation of the entire electronic musical instrument on the basis of the program memory stored in the ROM 3 by employing a register provided in a random-access memory (RAM) 4 or the like circuit.

A waveform memory 6 consists of a ROM and stores waveform data for plural tones, each consisting of amplitude information arranged in time sequence and obtained by sampling a tone waveform. There is also stored data of "0" corresponding to a silent (no sound) state at a location before each waveform data.

Figure 3:
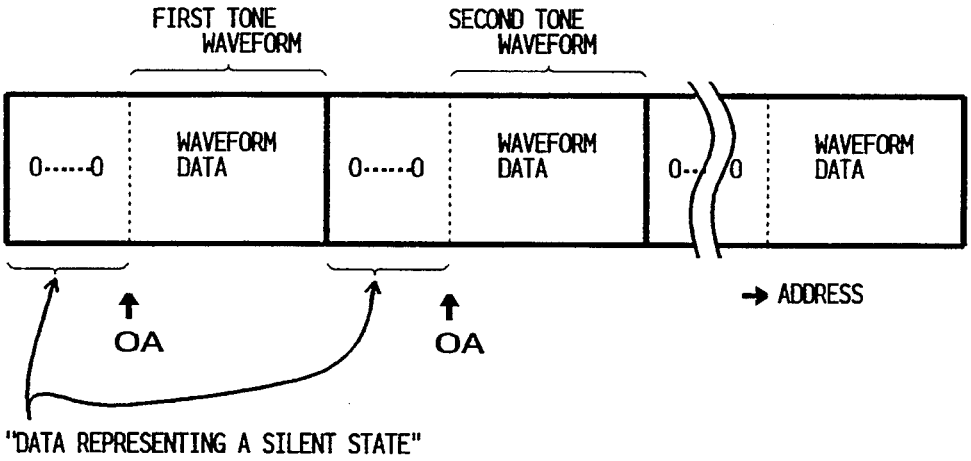
FIG. 3 is a diagram showing schematically an example of contents of storage in a waveform memory in FIG. 1.

As illustrated in FIG. 3, for example, data of "0", i.e., data representing a silent state, is written at a predetermined number of addresses from an initial address following which first waveform data corresponding to a first determined tone (e.g., a kind of a piano tone) is stored. Further, following this first waveform data, data of "0" at a predetermined number of addresses, subsequent second waveform data corresponding to a second determined tone, data of "0", next waveform data, etc. are written, i.e., data of "0" and waveform data are alternately written.

The tone source circuit 7 is a tone source which can sound a plurality of tones, e.g., 16 tones, simultaneously by a time division multiplexing processing. The tone source circuit 7 reads out waveform data by generating read addresses for accessing the waveform memory 6 on the basis of various data supplied from the CPU 5 through the bus 9 and supplies the read out waveform data as a digital tone signal to a sound system 8 after imparting envelope to the waveform data. The sound system 8 sounds a tone by digital-to-analog converting and amplifying the digital tone signal from the tone circuit 7.

Figure 5:
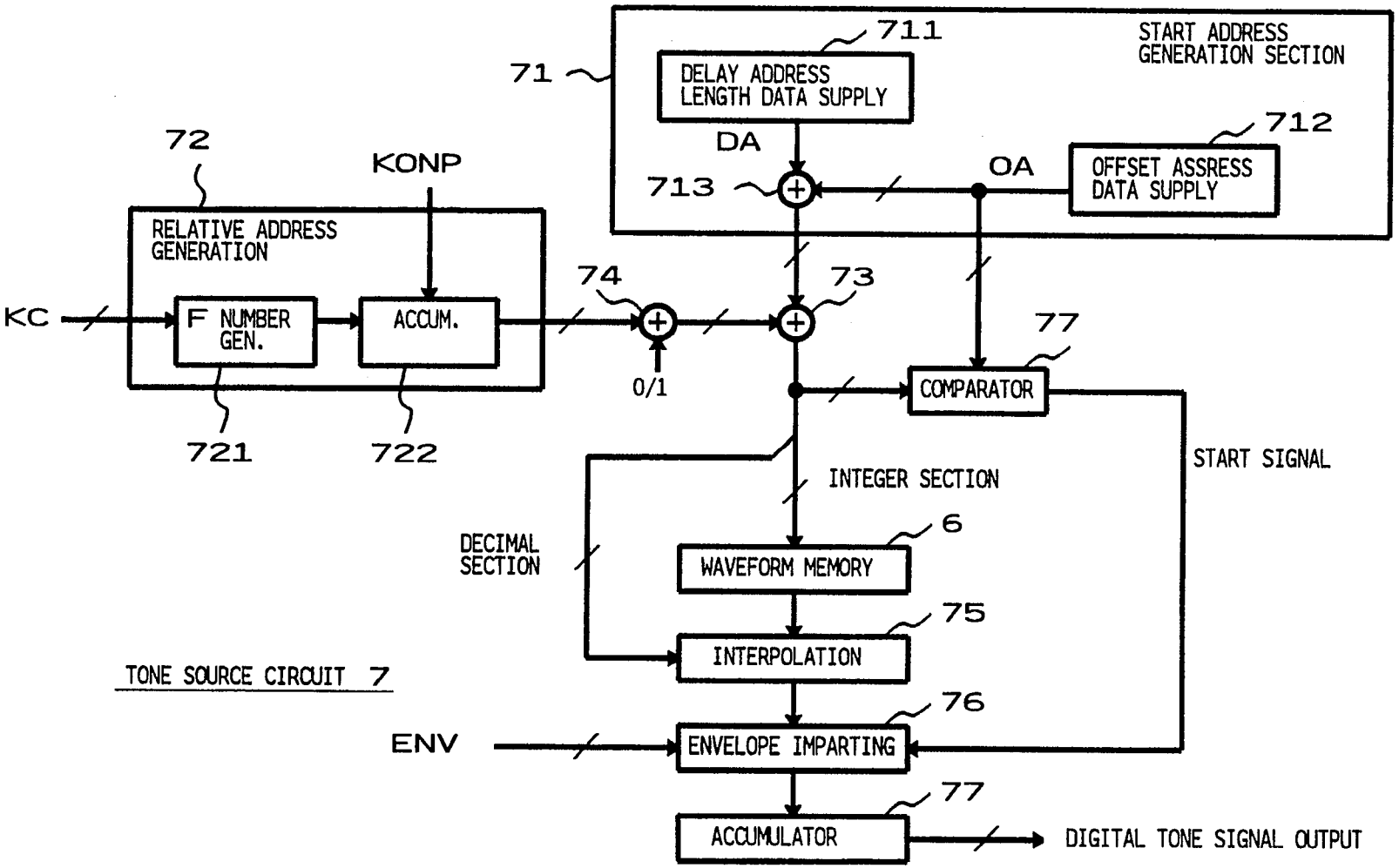
FIG. 5 is a block diagram of an example of a tone source circuit in FIG. 1.

FIG. 5 is a block diagram of the tone source circuit 7. To this tone source circuit 7 are applied, by a control to be described later, a key code KC, a key-on signal KON, an offset address and envelope data ENV corresponding to tone color data and delay address length DA corresponding to delay time of key-on delay.

Figure 4:
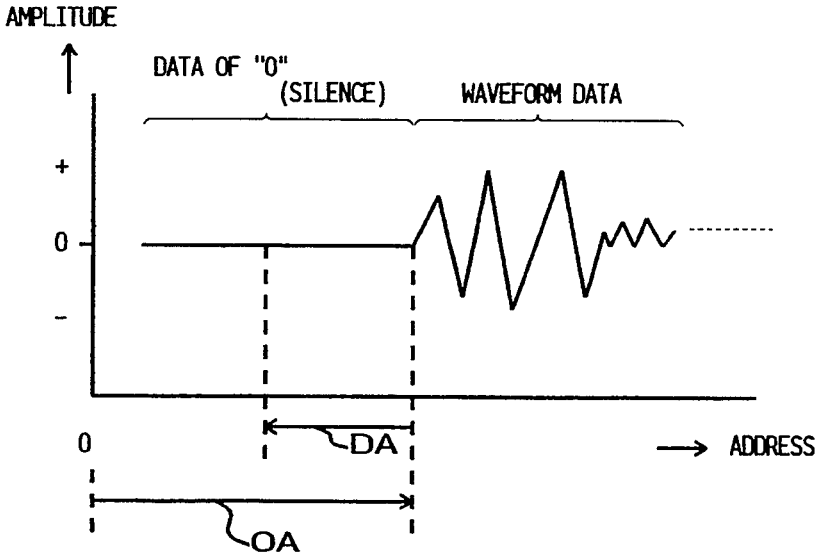
FIG. 4 is a diagram for explaining relationship among waveform data, offset address and delay address length of the same embodiment.

The offset address OA represents, as shown in FIG. 4 for example, the starting address of waveform data of a selected tone color and the delay address length DA represents relative address information to the offset address OA for designating a read start address from the "0" data stored before the waveform data.

This offset address OA and the delay address length DA constitute a set for a tone of each line to be sounded. Two sets of the offset address OA and delay address length DA corresponding to tones of two lines are applied to the tone source circuit 7 at each single key-on and the tone source circuit 7 performs tone generation processings for the tones of two lines by using two channels for a single key-on. Although this tone source circuit 7 is constructed to perform a processing for each tone generation channel on a time shared basis, for the sake of brevity, a series of operations for a single tone generation channel only will be described.

In FIG. 5, a start address generation section 71 includes a delay address length data supply section 711, an offset address data supply section 712 and an adder 713. The delay address length data supply section 711 and the offset address supply data section 712 respectively store data of the delay address length DA and data of the offset address OA in circuits such as registers corresponding to tone generation channels and supply the stored data in correspondence with respective channels.

The adder 713 adds data of the delay address length DA supplied by the delay address length data supply section 711 and data of the offset address 0A supplied by the offset address data supply section 712 together and supplies a sum to an adder 73. Data representing a start address for starting reading in the waveform memory 6 is thereby generated.

A relative address generation section 72 includes an F number generation section 721 and an accumulation section 722. The F number generation section 721 produces, as an F number, a ratio of a pitch corresponding to a key code KC applied from the CPU 5 and a pitch of an original tone waveform which was actually sampled and stored in the waveform memory 6.

The accumulation section 722 accumulates, upon application thereto of a key-on pulse KONP generated in response to the key-on signal KON applied from the CPU 5, the F number provided by the F number generation section 721 at a sampling period of the original tone waveform and supplies an accumulated value to an adder 74. The adder 74 adds "0" and "1" alternately to the accumulated value supplied by the accumulation section 712 and supplies a sum to the adder 73.

The adder 73 adds the output of the adder 74 to the start address provided by the start address generation section 71 and supplies an integer section of a sum to the waveform memory 6 and a decimal section to an interpolation section 75.

The output of the adder 73 is a value which increases by a value of the F number from the start address value. By using the integer section of this output of the adder 73 as the read address for the waveform memory, waveform data read from the waveform memory 6 is converted to waveform data of a pitch corresponding to the key code KC and this waveform data is applied to the interpolation section 75.

By the alternate addition of "0" and "1" by the adder 74, waveform data of a current address and waveform data of a next address are applied to the interpolation section 75. The interpolation section 75 interpolates waveform data by using the decimal section of the output from the adder 73 and supplies interpolated waveform data to an envelope imparting section 76.

On the other hand, comparator 77 compares the offset address OA provided by the offset address data supply section 712 with the output of the adder 73 and, when the output of the adder 73 has exceeded the value of the offset address OA, supplies a start signal to the envelope imparting section 76. The envelope imparting section 76 starts an envelope imparting processing upon receipt of the start signal.

The envelope imparting section 76 which includes a multiplier and other circuits supplies, when the start signal has not been generated, input waveform data directly to an accumulator 77 and, when the start signal has been generated, supplies to the accumulator 77 waveform data imparted with an envelope by multiplying envelope data ENV with the input waveform data.

The accumulator 77 accumulates waveform data applied in the above described manner by the number of the tone generation channels and supplies an accumulated value as a digital tone signal to the sound system 8.

In the electronic musical instrument of this embodiment, predetermined numbers of waveform data of the waveform memory are treated as tone color parts called "timber" and waveform of two parts are provided for each of these tone color numbers by assigning timber numbers indicating these timber parts to the respective tone color numbers of the tone color selection switches 21.

As shown in FIG. 6, for example, tone color data groups of 20 sets from Timber 1 to Timber 20 are stored in the ROM 3 as table data having a timber number "t" as an index. Each tone color data group includes data representing offset address OA of waveform data of a tone color assigned to each timber number "t" and envelope data ENV determining an envelope to be imparted to the waveform data.

Further, as shown in FIG. 7, there are stored, as table data, in the ROM 3, data representing the timber number "t" and data representing delay address length DA of the line Timber A corresponding to a first tone color part for an ensemble effect and data representing the timber number "t" and data representing delay address length DA of the second Timber B corresponding to a second tone color part for the ensemble effect, respectively for each tone color number TN.

As to a tone color which is used as a tone having an ensemble effect among the ten types of tone colors, as shown in the case of tone color number TN=1 in FIG. 7, the respective numbers "t" of the first Timber A corresponding to the first tone color part and the second Timber B corresponding to the second tone color part which are set for this tone color number TN are set at an equal value. As to the delay address lengths DA of these first Timber A and the second Timber B, one of the delay address lengths is set to "0" and the other to "1".

Generation of the respective tones corresponding to the first and second Timbers A, B are assigned to separate channels.

By this arrangement, a tone assigned to a channel for which the delay address length DA is set to "0" is generated simultaneously with the key-on whereas another tone assigned to another channel for which the delay address length DA is set to "1" is generated with a delay from the key-on, since reading is started from the "0" data before the waveform data.

As shown in the case of tone color number TN=10 in FIG. 7, in this embodiment, a tone of a special tone color for another ensemble effect which is a composite tone of different tone waveforms can be obtained by setting both the delay address lengths DA of the first Timber A and the second Timber B to "0" and differring the respective timber numbers "t".

Figure 8:
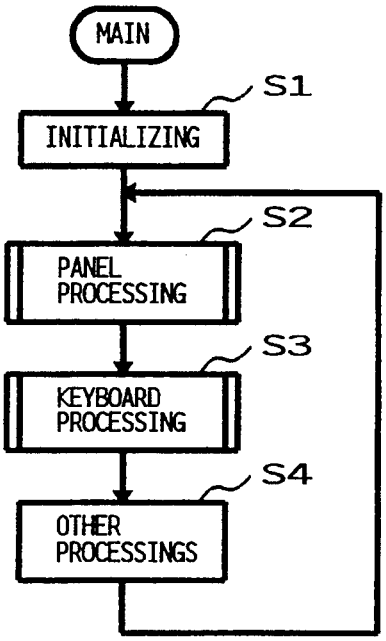
FIG. 8 is a flow chart of a main routine executed by a computer in FIG. 1.
Figure 9:
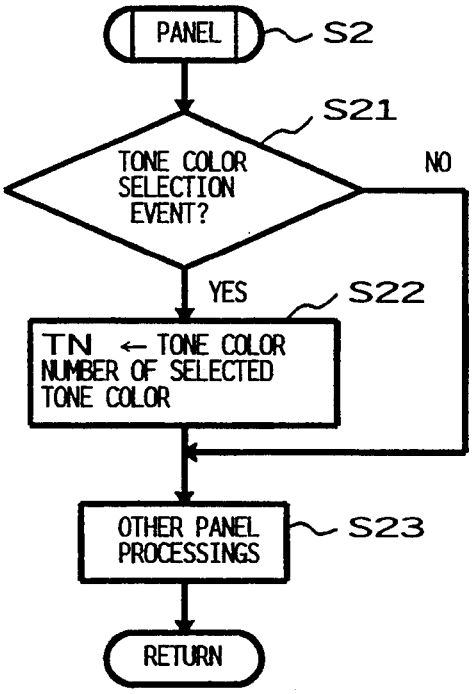
FIG. 9 is a flow chart of panel processing in FIG. 8.
Figure 10:
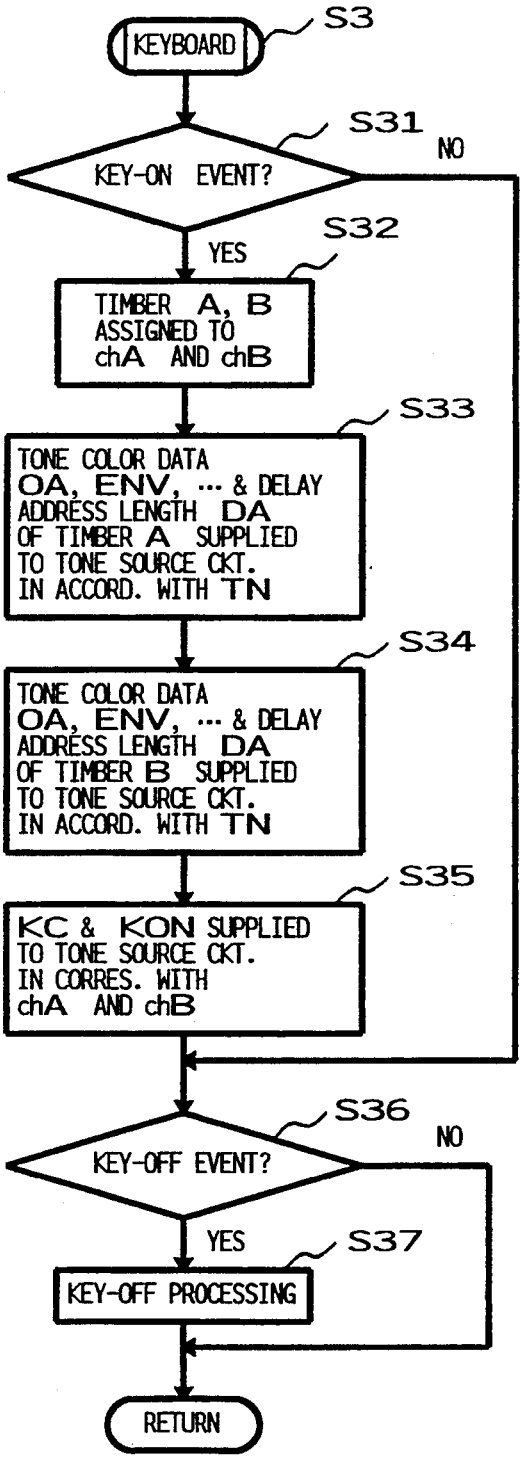
FIG. 10 is a flow chart of a keyboard processing in FIG. 8.

FIG. 8 is a flow chart of the main routine of the control program in this embodiment and FIGS. 9 and 10 are flow charts of subroutines of this control program. Upon turning on of a power, the CPU 5 starts processing of the main routine of FIG. 8, performing initializing such as setting up of the respective registers in step S1.

Then, a panel processing of FIG. 9 is performed in step S2, a keyboard processing of FIG. 10 is performed in step S3 and other processings are performed in step S4, the processings of step S2 and thereafter being repeated.

In the panel processing S2 in FIG. 9, whether there has been a switch event of the tone color selection switches 21 or not is detected. When there is no switch event, the routine proceeds to step S23 whereas when there is a switch event, the tone color number of the operated switch is stored in a register TN in step S22 and then the routine proceeds to step S23. In step S23, other panel processing is executed and then the routine returns to the main routine.

In the keyboard processing in FIG. 10, whether there has been a key-on event or not is detected in step S31. When there is no key-on event, the routine proceeds to step S36. When a key-on event has been detected in step S31, an assignment of a tone generation channel in the tone source circuit 7 is made in step S32 whereby two channels chA and chB corresponding to the first Timber A and second Timber B are obtained.

Then, in step S33, tone color data (offset address OA, envelope data ENV etc.) of Timber A according to the currently set tone color number IN and data of delay address length DA of Timber A are read from the ROM 3 and supplied to the tone source circuit 7. Similarly, in step S34, tone color data of Timber B and delay address length DA of Timber B are supplied to the tone source circuit 7. In step S35, the key code KC and the key-on signal KON are supplied to the channels chA and chB of the tone source circuit 7 to designate tone generation.

Upon completion of the above processings, whether there has been a key-off event or not is detected in step S36. When there is no key-off event, the routine returns to the main routine whereas when there is a key-off event, a key-off processing is executed in step S37 and thereafter the routine returns to the main routine.

By the above processings, when a tone color number of a tone which has been determined to be a tone having an ensemble effect has been selected, a tone of one line is sounded simultaneously with the key-on and a tone of the other line is sounded with a delay from the key-on and the ensemble effect due to the key-on delay is thereby produced.

Assuming now that waveform data of the waveform memory 6 is recorded at a sampling frequency of 50 kHz, waveform data is read out at a frequency of 50 kHz during reproduction in the tone source circuit 7.

When the F number is 1, 0 at this time, waveform data is read out sample point by sample point whereby the sampling key is performed, i.e., the original tone is reproduced as it is. When the F number is 2, 0, waveform data is read out at every other sample point so that a tone having a pitch which is double that of the original tone is reproduced.

The value of the delay address length DA is a value set in accordance with the original waveform data and set in such a manner that phase difference between waveforms of the two lines sounded will become optimum with respect to the ensemble effect. By delaying the tone generation by controlling the start address for reading out waveform data as described above, this phase difference becomes constant regardless of the key code KC (tone pitch).

Assume, for example, that delay address length DA designates data of "0" which is 25 data before the first sampling data of waveform data for a tone of 440 Hz (tone of A3 in the keyboard). Upon depression of the A3 key, the tone of the delayed line is sounded with a delay of 0.5 msec (25/50 kHz) from the key-on. When a key of A4 (tone of 880 Hz which is one octave above A3) has been depressed, a tone of the delayed line is sounded with a delay of 0.25 msec.

Since, however, the delays are 0.5 msec in the tone of 440 Hz and 0.25 msec in the tone of 880 Hz, the phase difference becomes in each case $$440\ \text{Hz} \times 0.5\ \text{msec} = 0.22\ \text{cycle}$$

$$880\ \text{Hz} \times 0.25\ \text{msec} = 0.22\ \text{cycle}$$

so that the phase differences become equal to each other.

In other words, since the pitch of a tone is in inverse proportion to the delay time, the phase difference between the two lines becomes constant by the value of the delay address length DA despite the difference in the tone pitch.

The waveform data may be a sampled value of tone amplitude or may be data obtained by compressing the sampled value. In the case of compressed data obtained by storing difference of a sampled value, for example, waveform data is sequentially added during reproduction but, as to a tone of the delayed line, data of "0" corresponding to the delay time only is added after key-on so that a silent state can be maintained.

In a tone color which may have a variation in the phase difference, the delay address length DA may be key scaled or changed in accordance with operation such as a touch on the depressed key or operation of a switch on the panel.

When waveforms of the same shape having different delay lengths are sounded from different loudspeakers, a predetermined sound image orientation can be obtained. A tone may be generated in plural lines exceeding two lines.

In the above described embodiment, the delay time is determined for each tone color. Alternatively, as in the embodiment to be described below, the delay time may be selected depending upon phase information representing phase difference between waveforms of two lines.

For example, as shown in FIG. 11, as tone color data groups stored as table data in the ROM 3 in correspondence to respective timber numbers "t", plural delay address lengths DA corresponding to phase differences of one sixth cycle, one fifth cycle, a quarter cycle, one third cycle etc. are prestored in addition to the offset address OA and envelope data ENV which are the same data as stored in the above described embodiment.

Further, as shown in FIG. 12, as tone color data stored in the ROM 3 in correspondence to the respective tone color number TN, the timber number t and flag D=0 indicating presence or absence of delay for the first line Timber A and the timber number "t" and flag D=1 or 0 for the second Timber B are prestored. "D=1" means presence of delay and "D=0" means absence of delay. For a tone color having an ensemble effect, Timber A is set to D=0 and Timber B to D=1 whereas for a tone color having no ensemble effect, both Timber A and Timber B are set to D=0.

Further, by a panel processing made in the same manner as in FIG. 9 (i.e., the panel processings of step S23 and other processings), a processing for selectively inputting phase difference information such as one sixth cycle, one fifth cycle, a quarter cycle, one third cycle etc. is made by the user and the selected phase difference information is stored in the register or the like circuit.

In the key depression processing, when there is a key-on event, assignment of two channels chA and chB corresponding to Timber A and Timber B is made and offset address OA and envelope data ENV are read from tone color data groups of FIG. 11 for Timber A and Timber B in accordance with a timber number t corresponding to the currently set tone color number TN. As to a Timber in which D=1, delay address length DA corresponding to the selectively designated phase difference information is read out whereas as to a Timber in which D=0, the delay address length DA is set to 0.

These offset address OA, envelope data ENV and delay address length DA are supplied to the respective channels of chA and chB for Timber A and Timber B of the tone source circuit 7 and the key code KC and key-on signal KON are supplied to the channels chA and chB of the tone source circuit 7 to designate tone generation.

By the above described processings, when a tone color number which is set for a tone having an ensemble effect is selected, a tone of a first tone color part Timber A in this example) for which the flag is D=0 is sounded simultaneously with the key-on whereas a tone of a second tone color part (Timber B in this example) for which the flag is D=1 is sounded with a delay corresponding to the selectively designated phase difference from the key-on whereby a desired ensemble effect caused by a key-on delay can be obtained.

In the above described embodiment, the delay time is selected on the basis of phase information representing phase difference between two parts. Alternatively, this phase information may be previously set as tone color data. In this case, phase information for reading out the delay address length DA in FIG. 11 may be stored in one part in correspondence to the tone color number TN and its timber number t for the two lines and information for causing the delay address DA=0 may be stored in the other part and the same processing as described above may be performed with respect to the tone source during key-on.

In the waveform memory 6, the data representing a silent state and the tone waveform data need not be stored contiguously to each other. It is only essential that reading from the first address area storing the data representing a silent state and the second address area storing the tone waveform data be controlled as in the above described embodiment.

In a modified embodiment of the invention, the data representing a silent state may be stored in only one or a suitable plural number of address locations and the data representing a silent state may be read repeatedly from this address location or locations. In this case, detection means may be provided for detecting that the address signal has been generated from the relative address generation section 72 by a number of address locations corresponding to the delay address length data DA supplied from the delay address length data supply section 711. The data representing a silent state is repeatedly read from the waveform memory 6 until the detection by this detection means has been made and, thereafter, the address signal generated by the relative address generation section 72 is offset to a first address (namely, offset address OA) of the tone waveform data to be read from the waveform memory 6 to start reading of the tone waveform data.

In another modified embodiment of the invention, an arrangement may be made so that the data representing a silent state is not stored in the waveform memory 6. In this case, in the same manner as described above, detection means is provided for detecting that an address signal has been generated from the relative address generation section 72 by a number of address locations corresponding to the delay address length data DA supplied from the delay address length data supply section 711 and zero level data (i.e., data representing a silent state) is produced by prohibiting output from the waveform memory 6 until the detection by the detection means has been made and, after the detection, the address signal generated by the relative address generation section 72 is offset to a first address (namely, offset address OA) of the tone waveform data to be read from the waveform memory to start reading of the tone waveform data.

As described in the foregoing, according to the electronic musical instrument of the invention, zero data representing a silent state is stored at a location before waveform data in waveform memory means such as a waveform memory and, when an ensemble tone due to a key-on delay is generated, a phase difference is provided between actually sounded tones of plural parts, i.e., a tone of a first part which is read from the starting address of waveform data and a tone of a second part which is read from the zero data provided before the waveform data. As a result, an ensemble effect can be obtained with the phase relation in the key-on delay becomes constant regardless of tone pitch with a simple structure which does not require a circuit for counting delay time in the key-on delay.

The key-on delay technique according to the invention is applicable not only for obtaining an ensemble effect but also for realizing an independent key-on delay effect. In the latter case, a tone may be generated in a single channel only.

I claim:

1. A tone generation device comprising:

tone designation means for designating that a tone should be generated;

waveform memory means for storing data representing a silent state in a first address area having a first predetermined number of addresses and storing tone waveform data in a second address area;

address signal generation means for generating an address signal for reading out stored data from the waveform memory means; and control means for controlling the address signal generation means, having designation means for designating a second predetermined number of addresses of said first address area from which the data representing a silent state is to be read out, said second predetermined number being any optional number no greater than said first predetermined number of addresses, so as to read out the data representing a silent state from the second predetermined number of addresses of said first address area designated by said designation means in response to the designation of tone generation and thereafter read out the tone waveform data from the second address area.

2. A tone generation device as defined in claim 1 which further comprises means for generating tone pitch information designating tone pitch of a tone to be generated and wherein said address signal generation means generates the address signal which increments or decrements at a rate corresponding to the tone pitch information.

3. A tone generation device as defined in claim 1 wherein the data representing a silent state is data representing zero value.

4. A tone generation device as defined in claim 1 wherein said control means includes designation means for designating the second predetermined number of addresses for reading out the data representing a silent state.

5. A tone generation device as defined in claim 4 wherein said designation means designates the second predetermined number of addresses in correspondence with a tone color of the tone to be generated.

6. A tone generation device as defined in claim 4 wherein said designation means designates the second predetermined number of addresses in correspondence with a tonal effect to be imparted to the tone.

7. A tone generation device as defined in claim 4 wherein said designation means designates the second predetermined number of addresses in accordance with a desired delay time from a time point when start of tone generation is designated by the tone designation means until a time point when tone generation is actually started.

8. A tone generation device as defined in claim 4 wherein said designation means designates the second predetermined number of addresses in accordance with a desired amount of phase delay from a time point when start of tone generation is designated by the tone designation means until a time point when tone generation is actually started.

9. A tone generation device as defined in claim 1 wherein said control means is capable of designating the second predetermined number of addresses for reading out the data representing a silent state to zero or any other desired number.

10. A tone generation device as defined in claim 1 wherein said address signal generation means generates address signals in at least two channels in response to the designation of tone generation by said tone designation means, and said control means designates the second predetermined number of addresses for reading out the data representing a silent state independently and in correspondence to the respective channels and controls said address signal generation means independently for each of the channels in accordance with the designated second predetermined number of addresses whereby time length during which the data representing a silent state is read out can be varied for each of the channels.

11. A tone generation device as defined in claim 10 wherein said control means designates the second predetermined number of addresses for reading out the data representing a silent state to zero with respect to a first channel of said channels thereby to read out the tone waveform data immediately in accordance with the designation of tone generation without reading out the data representing a silent state and designates the second predetermined number of addresses for reading out the data representing a silent state to a number other than zero with respect to a second channel of said channels to delay start of reading of the tone waveform data.

12. A tone generation device as defined in claim 1 wherein said first address area is contiguous to said second address area in said waveform memory means.

13. A tone generation device comprising:

tone designation means for designating generation of a tone;

waveform memory means for storing tone waveform data;

address signal generation means for generating, in response to the designation of tone generation by said tone designation means, an address signal for reading out the tone waveform data from said waveform memory means in accordance with tone pitch of a tone to be generated;

delay address length data generation means for generating delay address length data designating a silent period before start of tone generation for a duration corresponding to the delay address length data;

detection means for detecting, in response to the designation of tone generation by said tone designation means, progress of the address signal by an amount corresponding to the delay address length data generated by said delay address length data generation means; and control means for producing data representing a silent state until the detection by said detection means has been made and thereafter offsetting the address signal generated by said address signal generation means to a start address of the tone waveform data to be read from said waveform memory means thereby to start reading of the tone waveform data.

14. A tone generation device comprising:

tone designation means for designating generation of a tone;

waveform memory means for storing data representing a silent state and tone waveform data;

address signal generation means for generating, in response to the designation of tone generation by said tone designation means, an address signal for reading out the tone waveform data from said waveform memory means in accordance with tone pitch of a tone to be generated;

delay address length data generation means for generating delay address length data designating a silent period before start of tone generation for a duration corresponding to the delay address length data;

detection means for detecting, in response to the designation of tone generation by said tone designation means, progress of the address signal by an amount corresponding to the delay address length data generated by said delay address length data generation means; and control means for controlling so that data representing a silent state are read out from said waveform memory means until the detection by said detection means has been made and thereafter the address signal generated by said address signal generation means is offset to a start address of the tone waveform data to be read from said waveform memory means thereby to start reading of the tone waveform data.

* * * * *